US007151521B2

(12) United States Patent
Willis et al.

(10) Patent No.: US 7,151,521 B2
(45) Date of Patent: Dec. 19, 2006

(54) METHODS AND APPARATUS FOR DRIVING PIXELS IN A MICRODISPLAY

(75) Inventors: Thomas E. Willis, Mountian View, CA (US); Oleg Rashkovskiy, Cupertino, CA (US); Steven J. Kirch, Pleasanton, CA (US)

(73) Assignee: Intel Corporation, Santa Clara, CA (US)

( * ) Notice: Subject to any disclaimer, the term of this patent is extended or adjusted under 35 U.S.C. 154(b) by 399 days.

(21) Appl. No.: 10/404,009

(22) Filed: Mar. 31, 2003

(65) Prior Publication Data

US 2004/0189582 A1 Sep. 30, 2004

(51) Int. Cl.
*G09G 3/36* (2006.01)

(52) U.S. Cl. ..... 345/99; 345/204; 345/694; 365/49; 365/189.07

(58) Field of Classification Search ..... 345/212, 345/691, 204, 694; 365/49, 189.07
See application file for complete search history.

(56) References Cited

U.S. PATENT DOCUMENTS 4,499,459 A * 2/1985 Sasaki et al. ..... 345/55
5,184,325 A * 2/1993 Lipovski ..... 365/189.07
6,714,191 B1 * 3/2004 Wu et al. ..... 345/204
2002/0011994 A1 * 1/2002 Imamura
2002/0158857 A1 * 10/2002 Iisaka
2003/0160804 A1 * 8/2003 Willis et al. ..... 345/694
2003/0169612 A1 * 9/2003 Hu ..... 365/49
2003/0201986 A1 * 10/2003 Willis et al. ..... 345/204

OTHER PUBLICATIONS

Travis N Blalock, Neela B. Gaddis, Ken A. Nishimura and Thomas A. Knotts, "True Color 1024 X 768 Microdisplay with Analog In-Pixel Pulsewidth Modulation and Retinal Averaging Offset Correction", *IEEE Journal of Solid-State Circuits,* vol. 36, No. 5, May 2001, pp. 838-845.

* cited by examiner

*Primary Examiner*—Sumati Lefkowitz
*Assistant Examiner*—Tammy Pham
(74) *Attorney, Agent, or Firm*—Buckley, Maschoff & Talwalkar LLC

(57) ABSTRACT

A pixel is driven with pulse width modulation (PWM). A cycle for the PWM signal is divided into a plurality of super-intervals. Each of the super-intervals is divided into a plurality of intervals. An interval index is stored for the pixel. The timing at which the pixel is changed from one state to another is selected based on an enable signal and the stored interval index.

26 Claims, 7 Drawing Sheets

METHODS AND APPARATUS FOR DRIVING PIXELS IN A MICRODISPLAY

BACKGROUND

Spatial light modulators (SLMs) come in various forms including microdisplays. Some types of microdisplay are formed on a silicon substrate. Such a microdisplay may include a two-dimensional array of pixels on the silicon substrate with liquid crystal material above the pixel array. Each pixel is driven by electronics formed on the substrate. When digital signals are employed in driving the pixels, it may be necessary to buffer digital values for each pixel in a memory that is adjacent to each pixel. However, if one or more of the pixel memories fail, there can be a significant degradation in the image provided by the microdisplay. Accordingly, expensive repair or redundancy arrangements may be needed for the pixel memories.

DETAILED DESCRIPTION

Figure 1:
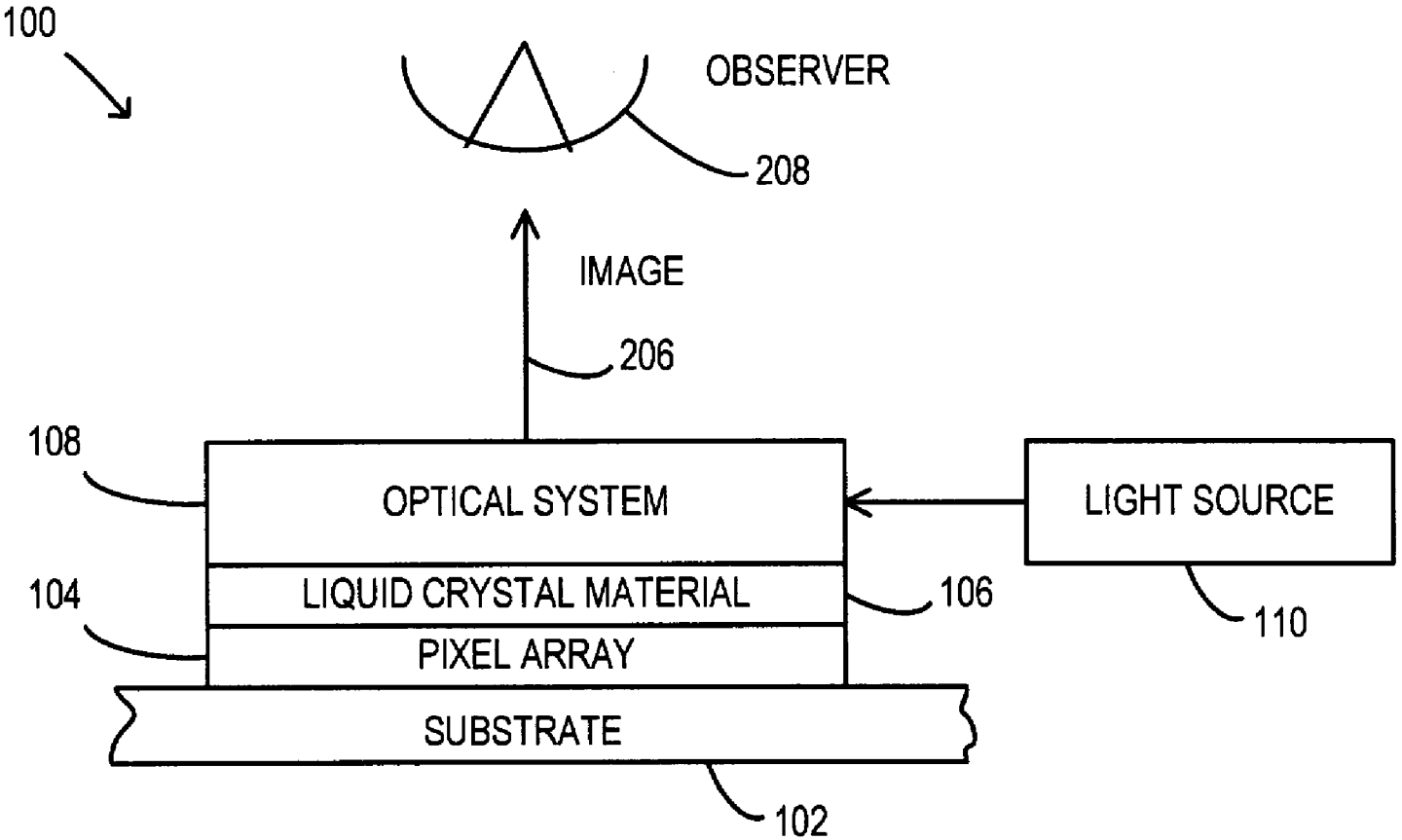
FIG. 1 is a schematic side cross-sectional view of a microdisplay according to some embodiments.

FIG. 1 is a schematic side cross-sectional view of a display device 100 according to some embodiments. The display device 100 may be formed on a silicon substrate 102, and includes a two-dimensional pixel array 104 formed on the substrate 102. The pixel array 104 includes a plurality of pixels, which are not separately shown in the drawing. In some embodiments the pixel array may have dimensions corresponding to hundreds or more pixels on a side. Driving electronics for the pixels are also not shown separately in FIG. 1 from the substrate 102 and the pixel array 104, but will be described further below.

A liquid crystal material 106, which may be provided in accordance with conventional practices, is associated with the pixel array 104. The display device 100 also includes an optical system 108, which is associated with the liquid crystal material 106, and a light source 110 which emits light into the optical system 108. The optical system 108 and the light source 110 may both be provided in accordance with conventional practices. In some embodiments the light source 110 may include a source of white light and a color wheel, which are not separately shown. In other embodiments the light source 110 may include red, green and blue light emitting diodes (not separately shown).

Figure 2:
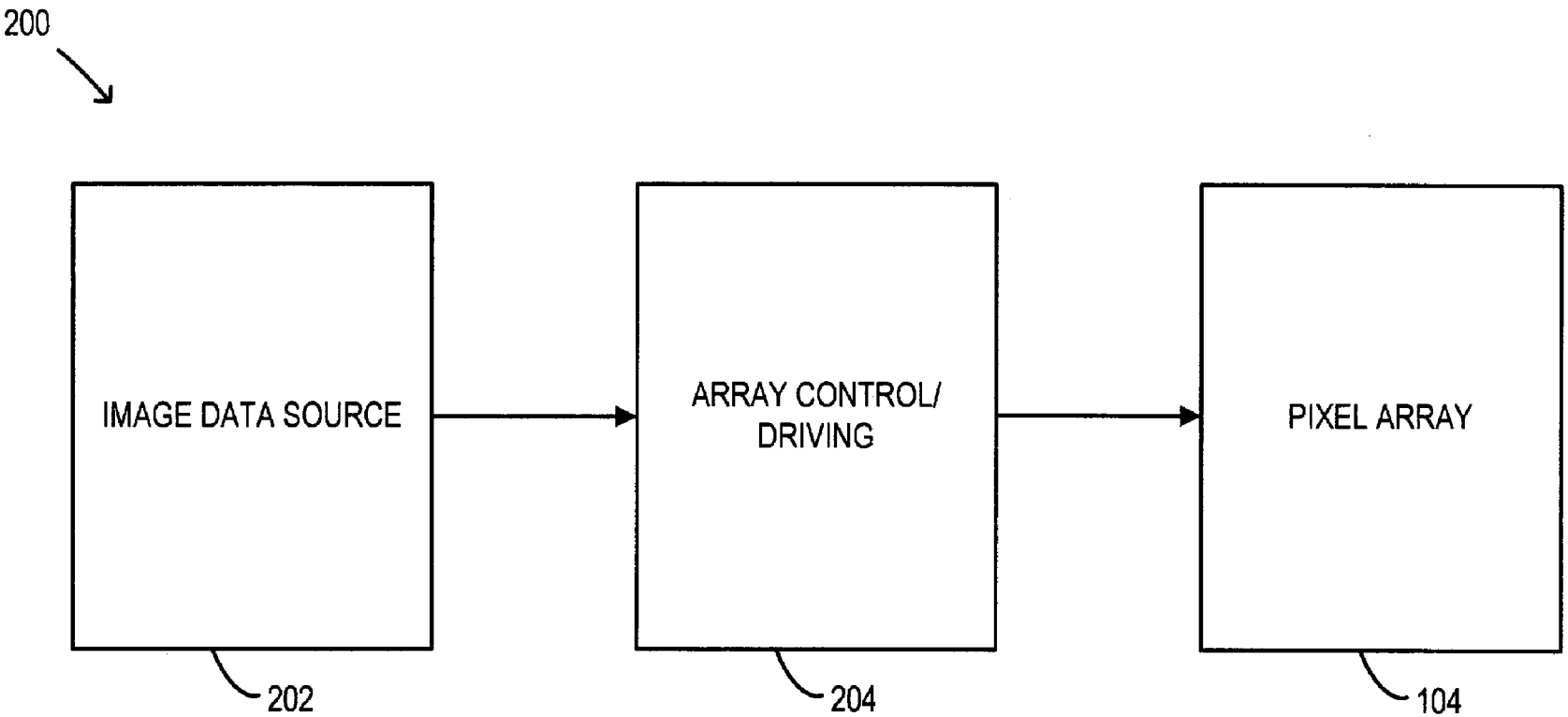
FIG. 2 is a block diagram that illustrates some aspects of a device that includes the microdisplay of FIG. 1.

FIG. 2 is a block diagram that illustrates aspects of a device 200 that may include the display device 100 of FIG. 1. The device 200 may be, for example, a handheld game device, a digital camera, a cellular telephone, a personal digital assistant (PDA) or another type of computing device. The device 200 may include an image data source 202. The image data source 202 may be, for example, the image-capture portion of a camera, a receiver that receives image data transmitted from another device, a storage medium such as a CD-ROM or a DVD, or the image-data-generating components of a game device.

The device 200 also includes electronic components 204 that handle control and driving of the pixel array 104. The array control and driving components 204 receive frames of digital image data from the image data source 202. The array control and driving components 204 may translate the image data from the image data source 202 into suitable values for driving each pixel. The pixel values may be buffered in the array control and driving components 204 and may be converted into signals for directly driving the pixels of the pixel array 104. In some embodiments, the image data from the image data source 202 may be mapped in a non-linear fashion into pixel driving values to compensate for non-linear characteristics of the liquid crystal material 106 and for non-linearity of human visual perception. For example, because the human visual system is highly sensitive to low levels of light and is relatively insensitive to variations in high levels of light, a non-linear mapping of the image data to the pixel-driving values may provide for relatively high intensity resolution for dark pixels in an image frame, and relatively low intensity resolution for bright pixels in the image frame.

In some embodiments, each image frame period may be divided into three sub-periods, each of which corresponds to red, green or blue components of the image frame. During the corresponding sub-period, the light source emits red, green or blue light, as appropriate, and the pixels are driven to provide a gray scale image that corresponds to the light component for the sub-period. During each sub-period, the image light 206 (FIG. 1) passes from the optical system 108 to the observer 208. The sub-periods are brief enough and near enough to each other in time to allow for retinal averaging to form a composite color image from the separate red, green and blue images provided in the respective sub-periods.

The respective pixel values for each pixel in the gray scale images are applied to the pixels by pulse width modulation. The display device 100 may operate such that the brighter pixels in the gray scale image are actuated for longer portions of the sub-period when driven with longer pulse widths, and darker pixels in the gray scale image are actuated for shorter portions of the sub-period when driven with shorter pulse widths. Alternatively, the liquid crystal material 106 may be such that the pulses turn off the pixels, in which case longer pulse widths may be applied to darker pixels and shorter pulse widths may be applied to brighter pixels.

Figure 3:
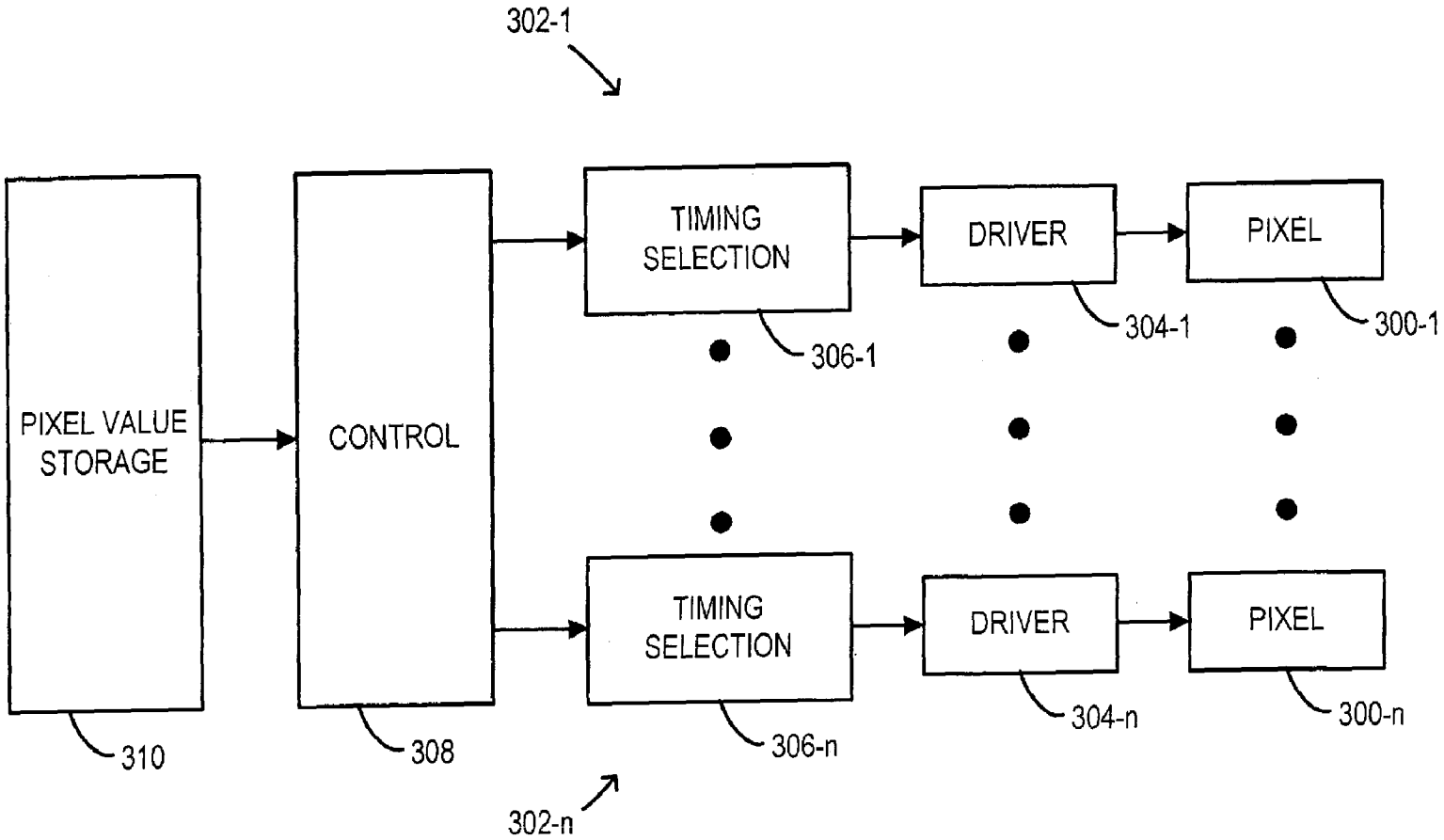
FIG. 3 is a more detailed block diagram that illustrates a pixel driving arrangement according to some embodiments.

FIG. 3 is a more detailed block diagram that shows aspects of the array control and driving components 204 of FIG. 2 according to some embodiments. In FIG. 3, pixels 300 are shown. The pixels 300 may constitute all or a subset of the pixels which make up the pixel array 104. Coupled to each pixel 300 is a respective driving circuit 302. Each driving circuit 302 includes a driver 304 and a timing selection circuit 306. The drivers 304 are directly coupled to the pixels 300. Each driver 304 is arranged to be in an active condition when its associated timing selection circuit 306 outputs a first logic signal and is inactive when the associated timing selection circuit 306 outputs a second logic signal. When a driver 304 is in an active condition it outputs a driving signal to its associated pixel 300 so that the associated pixel 300 is actuated (on). When a driver is inactive it does not output the driving signal and the associated pixel is deactuated (off).

Each timing selection circuit 306 operates to select a timing at which a pulse width modulation signal used to drive the associated pixel 300 changes state. Thus the timing selection circuits may control the durations of the pulse widths and consequently the respective intensities of the pixels 300-1.

A control circuit 308 is coupled to the timing selection circuits 306. The control circuit 308 supplies data and control signals (both described below) to the timing selection circuits. The timing selection circuits 306 generate the PWM waveforms for the pixels 300 based on the data and control signals supplied from the control circuit 308. The operation of the control circuit 308, in turn, is based on pixel values which are refreshed for each sub-period, and which are stored in a pixel value storage circuit 310 that is coupled to the control circuit 308. The pixel values stored in the pixel value storage circuit 310 may be generated by suitable mapping (linear or non-linear) from image data provided by the image data source 202 (FIG. 2). Suitable circuitry to perform the mapping of image data to pixel values is not separately shown in the drawings. In some embodiments the image data may be 8 bits per color per pixel for each image frame, and each pixel value may be a 10-bit number.

Figure 4:
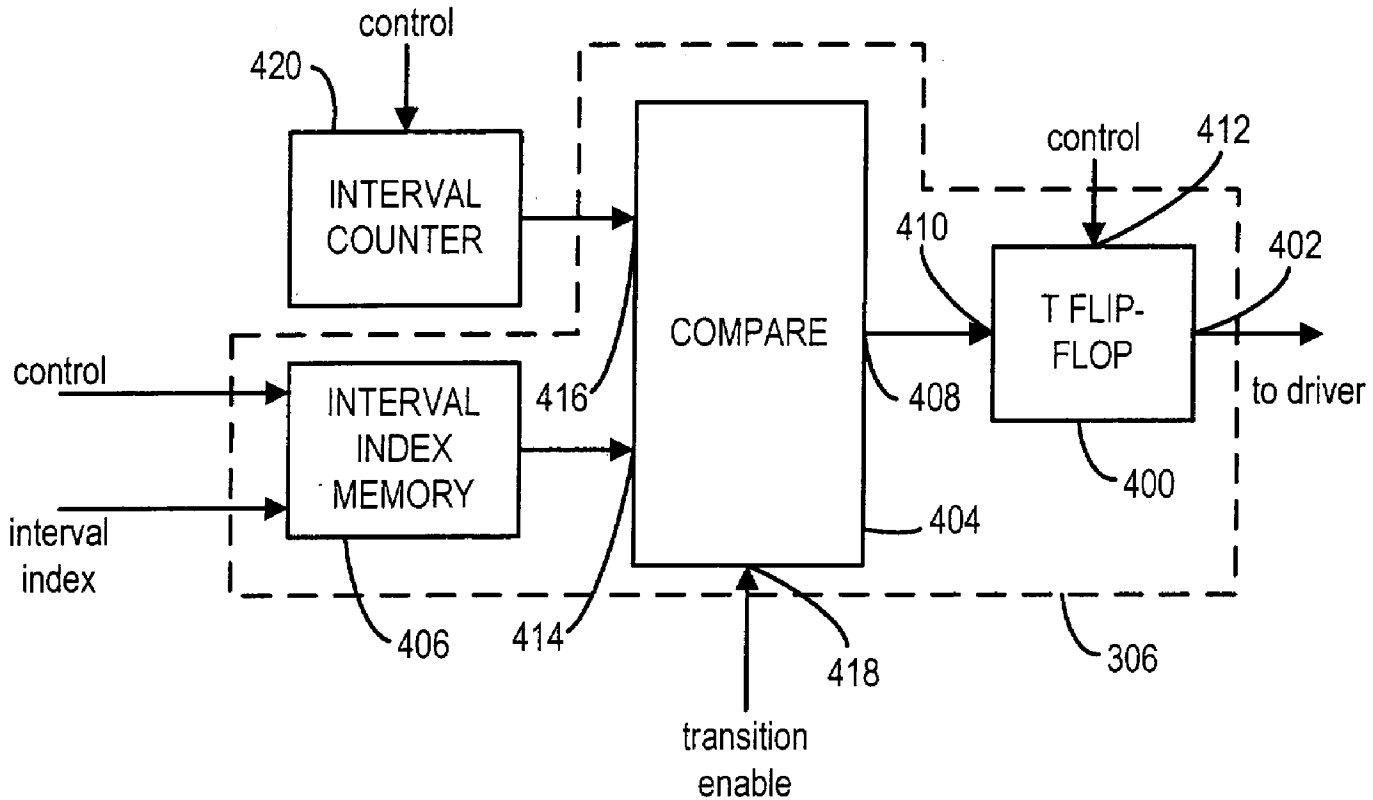
FIG. 4 is a further block diagram that illustrates additional details of the pixel driving arrangement of FIG. 3.

FIG. 4 is a block diagram that shows details of a typical one of the timing selection circuits 306 shown in FIG. 3. The timing selection circuit 306 includes a T (toggle) flip-flop 400 which has its output terminal 402 coupled to the corresponding driver (FIG. 3, not shown in FIG. 4). The timing selection circuit 306 also includes a comparison circuit 404 and an interval index memory 406. The comparison circuit 404 has an output terminal 408 that provides a comparison signal to an input terminal 410 of the T flip-flop 400. Another input terminal 412 of the T flip-flop 400 is coupled to the control circuit 308 (FIG. 3, not shown in FIG. 4) to receive a control signal from the control circuit. The T flip-flop functions to change its state ("toggle") upon receiving either a logical "high" signal at its input 410 or upon receiving the control signal at its input 412.

The comparison circuit 404 has two compare inputs 414, 416 and an enable input 418. The compare input 414 is coupled to the interval index memory 406. The interval index memory 406 stores an interval index signal that is received for each sub-period from the control circuit 308 (FIG. 3). The interval index signal may be, for example, the low order bits of a pixel value for the corresponding pixel for the current sub-period. The interval index memory 406 provides the interval index signal to the comparison circuit 404 via the compare input 414 of the comparison circuit 404.

The other compare input (reference numeral 416) of the comparison circuit 404 is coupled to an interval counter 420, which may be part of the control circuit 308. The interval counter 420 is reset to zero at the start of each sub-period by a control signal provided by the control circuit, and operates to count up during the sub-period. (Alternatively, the interval counter 420 may "count over" to zero at the start of each sub-period.) The interval counter 420 provides its current count value to the input 416 of the compare circuit 404. The comparison circuit operates to compare the current count value from the interval counter 420 to the interval index signal from the interval index memory 406 and to output a logical "high" signal to the T flip-flop 400 at a time when the signals at the inputs 414, 416 are equal while the enable signal is asserted at the enable input 418.

Figure 5:
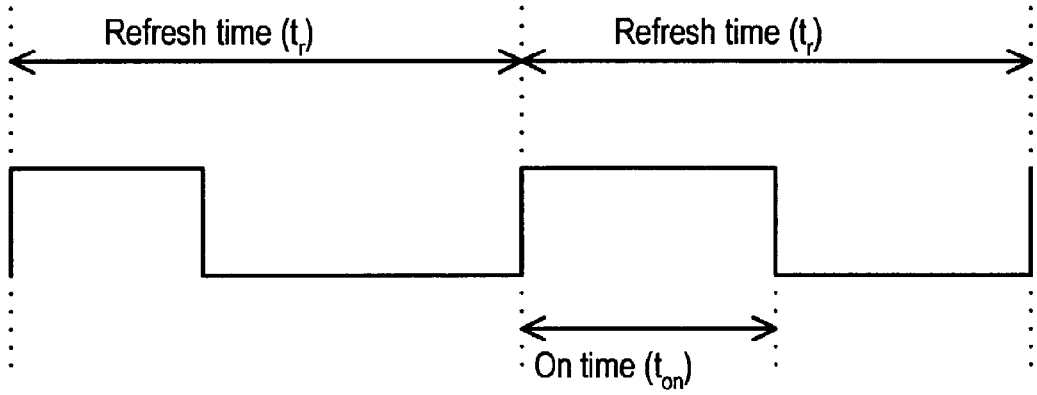
FIG. 5 is a waveform diagram that illustrates a pulse width modulation (PWM) pixel-driving signal.

In operation, each pixel is driven with a respective pulse width modulation signal, as illustrated in FIG. 5. In FIG. 5, the indicated "refresh time" corresponds to the duration of a sub-period, and the portion of the sub-period during which the pixel in question is to be activated is indicated as the "on time ($t_{on}$)". It will be observed from FIG. 5 that the on time ton may, and typically does, vary from one refresh period to the next.

For each image frame period, a frame of image data is received by the array control and driving components 204 from the image data source 202. The image data is translated into pixel values by circuitry which is not separately shown, and the resulting pixel values are stored in the pixel value storage circuit 310. The control circuit 308 controls the driving circuits 302 (FIG. 3) and particularly the timing selection circuits 304 so that the pixels 300 are driven with pulse width modulation signals that correspond to the pixel values stored in the pixel value storage circuit 310. It is a feature of the embodiment illustrated in FIGS. 3 and 4 that the interval index signal stored in the interval index memory 406 may consist of fewer bits than the pixel value for the associated pixel.

A simplified explanation of the operation of the control circuit 308 and the timing selection circuits 306 will now be described with reference to FIGS. 6 and 7. For the purpose of FIGS. 6 and 7, the pixel values are assumed to consist of four bits and the interval index signals are assumed to consist of two bits. However, it should be borne in mind that in other embodiments the pixel values may consist of 10 bits or another number of bits, and the interval index signals may consist of any number of bits that is less than the number of bits of the pixel values. The control circuit 308 (including the interval counter 420), the interval index memory 406 and the comparison circuit 404 may be arranged so as to accommodate the appropriate number of bits of the pixel values and the interval index signals.

Figure 6:
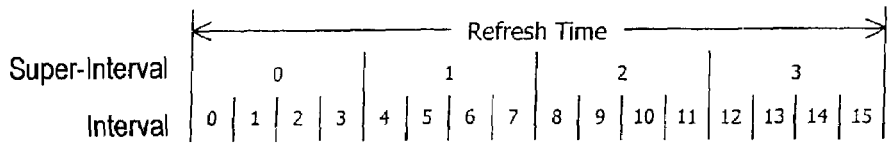
FIG. 6 is a diagram that illustrates how a pixel refresh time (cycle time) may be divided into intervals and super-intervals according to some embodiments.

FIG. 6 illustrates how a refresh time (also referred to as a cycle time) is divided into 16 intervals, consistent with the assumption that the pixel values are 4-bit numbers. The intervals are all of equal duration. The refresh time is also divided into four "super-intervals" each of which consists of, and is divided into, four of the intervals. As will be seen, the super-interval in which a pixel transitions from on to off is to be selected by a transition enable signal applied to the comparison circuit 404 by the control circuit 308, and the interval within the super-interval is selected by the comparison circuit 404 based on a comparison of the interval index signal stored in the interval index memory 406 and a current count value provided by the interval counter 420.

Figure 7:
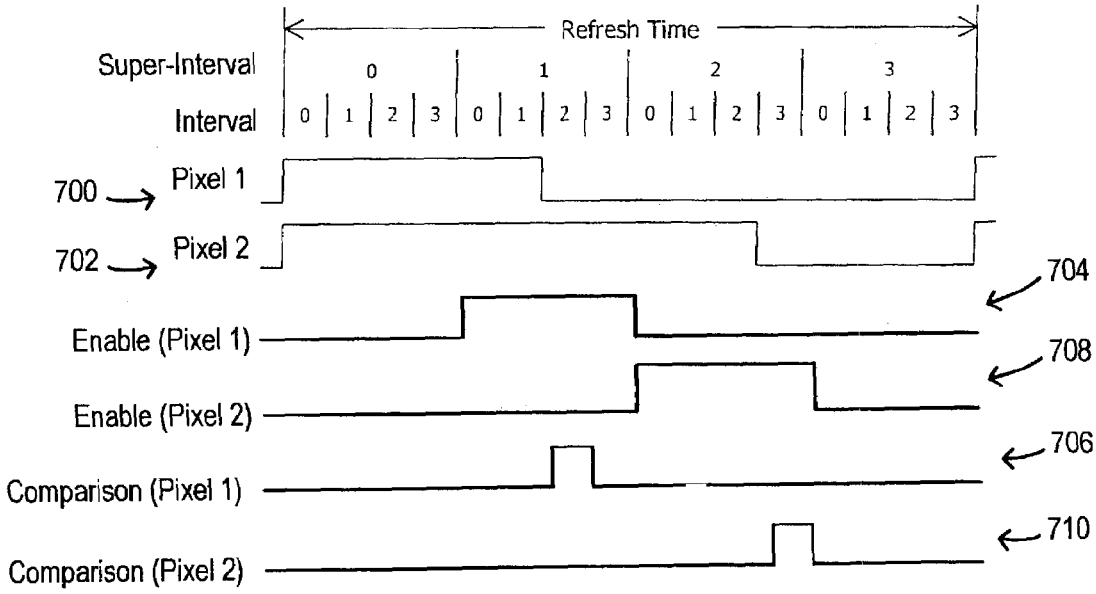
FIG. 7 is a waveform diagram that illustrates operation of the pixel driving arrangement of FIGS. 3 and 4.

FIG. 7 shows how the intervals within each super-interval may be numbered from "0" to "3" (in accordance with the assumption of two-bit interval indices). Waveform 700 illustrates a pulse signal that is to be applied to a first pixel (Pixel 1) in accordance with the pixel value for Pixel 1 in the current refresh time. In this example, the pulse for Pixel 1 is to have a width of 6/16 of the duration of the refresh time, with the pulse for Pixel 1 terminating at the start of interval 2 of super-interval 1.

Waveform 702 illustrates a pulse signal that is to be applied to a second pixel (Pixel 2) in accordance with the pixel value for Pixel 2 in the current refresh time. In this example, the pulse for Pixel 2 is to have a width of 11/16 of the duration of the refresh time, with the pulse for Pixel 2 terminating at the start of interval 3 of super-interval 2.

At the start of the refresh time, the control circuit 308 applies a control signal to the T flip-flops 400 (only one separately shown) of the timing selection circuits 306 for Pixels 1 and 2 (and indeed for each of the other pixels) to change the output of the T flip-flops from a logic "low" to a logic "high", so the driver 304 for each pixel causes the pixel to change from an off state to an on state. Also at the start of (or just prior to) the refresh time, the control circuit 308 loads suitable interval index signals into the respective interval index memories 406 of the timing selection circuits 306. The interval index signals may be, for example, the low order bits of the pixel values for the respective pixels. In the example illustrated in FIG. 7, the interval index loaded into the interval index memory for Pixel 1 has the value "10" (binary), corresponding to interval 2, and the interval index loaded into the interval index memory for Pixel 2 has the value "11" (binary), corresponding to interval 3.

Also at the start of the refresh time (which is also the start of super-interval "0"), the interval counter is reset to zero (or counts over from "11" to "00"). As will be seen, the interval counter is reset to zero (or counts over to zero) at the beginning of each super-interval. In this particular example, the interval counter is a two-bit counter, and counts up during each super-interval at a timing that corresponds to the duration of the intervals. Thus the current count value of the interval counter indicates the number of the current interval within the current super-interval.

In the first super-interval (super-interval "0") of the example illustrated in FIG. 7, the transition enable signal is not asserted to the comparison circuit 404 for either one of Pixels 1 and 2, since neither of those pixels is scheduled to transition from on to off during the first super-interval. (It will be appreciated that the transition enable signal is applied during the first super-interval to the comparison circuits associated with other pixels that are scheduled to transition from on to off during the first super-interval. These are the pixels that are to be driven with a pulse width that is less than one fourth of the duration of the refresh time.) Because the comparison circuits 404 for Pixels 1 and 2 are not enabled during super-interval "0", the comparison circuits 404 do not provide a logic "high" output to their respective T flip-flops 400 even when the current count provided by the interval counter 420 matches the interval index stored in their respective interval index memory 406.

At the start of the second super-interval (super-interval "1") the interval counter is again is reset-to zero (or counts over to zero). As indicated by waveform 704 in FIG. 7, the control circuit 308 applies the transition enable signal to the comparison circuit 404 for Pixel 1 during the super-interval "1" so that the comparison circuit 404 for Pixel 1 is in an enabled condition during super-interval "1". The interval counter 420 counts up from "00" during the super-interval "1". When the current count of the interval counter 420 reaches "10", which matches the interval index stored in the interval index memory 406 for Pixel 1, the comparison circuit 404 for Pixel 1 outputs a logic "high" signal (which may be considered to be a "comparison signal" and which is indicated in waveform 706, FIG. 7) to the T flip-flop 400. In response to the signal from the comparison circuit, the T flip-flop changes its state, thereby causing the associated driver 304 (FIG. 3) to turn Pixel 1 off. The resulting transition from on to off, terminating the pixel driving pulse, is shown in waveform 700.

At the start of the third super-interval (super-interval "2") the interval counter is again reset to zero (or counts over to zero). The transition enable signal is no longer applied to the comparison circuit for Pixel 1, but is applied to the comparison circuit for Pixel 2 during the super-interval "2" (as indicated by waveform 708, FIG. 7). As before, the interval counter 420 counts up from "00" during the super-interval "2". When the current count of the interval counter 420 reaches "11", which matches the interval index stored in the interval index memory 406 for Pixel 2, the comparison circuit 404 for Pixel 2 outputs a logic "high" signal (indicated in waveform 710) to the T flip-flop 400 for Pixel 2. In response to the signal from the comparison circuit, the T flip-flop changes its state, thereby causing the associated driver 304 (FIG. 3) to turn pixel 2 off. The resulting transition from on to off, terminating the pixel driving pulse, is shown in waveform 702.

The control circuit 308 does not apply the transition enable signal to the comparison circuits for Pixels 1 and 2 during the fourth super-interval (super-interval "3"), because the pulses for those pixels have already been terminated.

It will be appreciated that the control circuit 308 includes suitable timing and logic circuitry to generate the transition enable signals for each pixel on the basis of the respective pixel values (e.g., based on the high order bits of the pixel values).

By the end of the sub-period all pixels have been turned off. The light source 110 ceases to provide light of the type for the sub-period that is just ending and may begin immediately or after a "dark period" (not indicated in FIG. 5) to provide light of the appropriate type for the next sub-period. The pixel values for the next sub-period are stored in the pixel value storage circuit 310 and the control circuit 308 loads appropriate interval indices into the interval index memories for all the pixels based on the pixel values for the current sub-period. The pixels are again driven with pulses that terminate based on timings of the transition enable signals (generated based on the current pixel values) in combination with the interval index signals stored in the interval index memories.

Once the three sub-periods for the current frame have taken place, a new frame of image data is used to drive the display device 100 in the same manner as just described.

As noted above, the number of bits stored in each interval index memory may be less than the number of bits in the pixel values used to drive the pixels (of course, a suitable storage arrangement is provided in or associated with the control circuit to store data that governs proper generation of the transition enable signals). With the reduced number of bits stored in the interval index memory, the amount of memory required to be provided in close association with each pixel may be reduced. This may allow greater flexibility in arranging the electronics associated with each pixel. Also, because the memory for the other bits of the pixel values is physically separate from the pixel, that memory may be laid out with a greater degree of freedom, which may allow for more efficient design.

With the arrangement described above, it may also be possible to forego some or all of the customary repair and/or redundancy features for the pixel memory without unduly increasing exposure to image deterioration. In the arrangement of FIG. 4, if the interval index memory fails, the application of the enable signal will still result in ending of the pixel driving pulse in the correct super-interval, albeit possibly in the wrong interval of the super-interval. The resulting error in the display is thus minimized and may not significantly adversely affect the perceived image. The length of the super-intervals may be selected so as to aid in maximizing picture quality even in the case of interval index memory failure.

Figure 8:
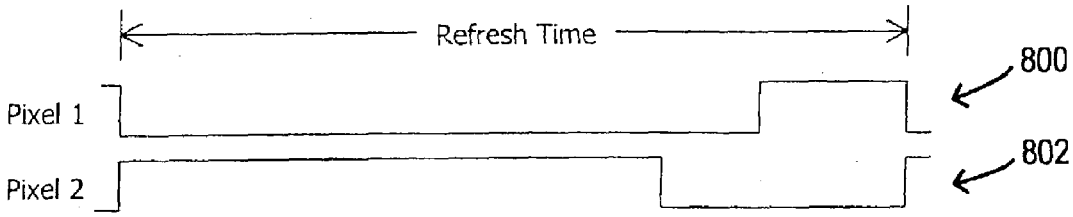
FIG. 8 is a waveform diagram that illustrates operation of an alternative pixel driving arrangement.
Figure 9:
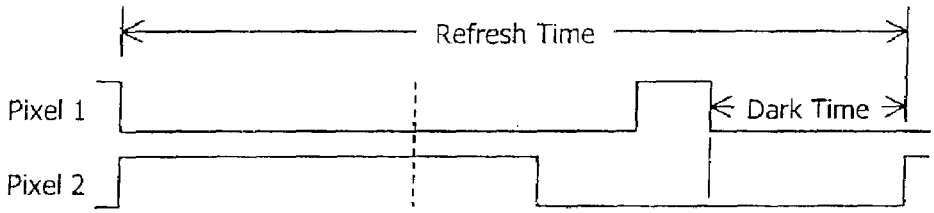
FIG. 9 is a waveform diagram that illustrates operation of another alternative pixel driving arrangement.

FIGS. 8 and 9 illustrate pixel driving waveforms that may be employed in other embodiments. Essentially the same hardware arrangement may be employed in these embodiments as was illustrated in FIGS. 1–4, except that the control circuit 308 operates somewhat differently so as to control the driving circuits 302 to generate PWM waveforms like the examples shown in FIG. 8 or FIG. 9.

In some embodiments, as indicated in FIG. 8, for pixel driving waveforms in which the "on" period for the pixel is to be half or less of the refresh time, the pixel is maintained in an off condition during the first half of the refresh time and does not transition from off to on until the second half of the refresh time (as indicated by waveform 800 in FIG. 8). The waveform then transitions from on to off at the end of the refresh time. The longer the desired "on" time (within the one half of the refresh time limitation), the earlier in the second half the off-to-on transition occurs.

For a pixel driving waveform in which the "on" period is to be more than half of the refresh time, a conventional PWM waveform (e.g. waveform 802 of FIG. 8) is used, with the waveform transitioning from off to on at the start of the refresh time and transitioning from on to off in the second half of the refresh time.

With this practice, no pixel driving waveform ever transitions during the first half of a refresh time (disregarding the transition that may occur right at the start of the refresh time, the start not being considered to be part of the first half of the refresh time). Consequently, the transition enable signal is never applied to a comparison circuit 404 during the first half of the refresh, and the interval index signal need not be loaded into the interval index memory until just before the start of the second half of the refresh time. As a result, bandwidth and buffering requirements may be reduced.

Also, the average number of pixels that are on in the second half of the refresh time may be increased by this practice, which may aid in reducing or eliminating image flickering.

In operation, the control circuit 308 may be arranged to determine for each pixel, on the basis of the current pixel value for that pixel, whether the pixel is to be driven for more than half, or half or less, of the refresh time. This determination may be made, for example, by examining the most significant bit of the pixel value. Based on this determination, the control circuit provides a control signal (if necessary) to the T flip-flop for the pixel so that the PWM waveform for the pixel is on in the first half of the refresh time (in the case of a "more than half" waveform), or so that the PWM waveform for the pixel is off in the first half of the refresh time (in the case of a "half or less" waveform). In the case of a "more than half" waveform, the interval index signal is loaded into the interval index memory for the pixel in the same fashion as in the practice described in connection with FIG. 7, except that, as noted above, the loading of the interval index signal into the interval index memory need not occur until just before the start of the second half of the refresh time. The enable signal is applied to the comparison circuit for the pixel at the suitable time in the second half of the refresh time to select the super-interval for the waveform transition. The interval counter may be operated in the same fashion as in the practices described in connection with FIG. 7, except that the interval counter could be idled in the first half of the refresh time. The comparison circuit selects the interval for transition within the selected super-interval in the same manner as described in connection with FIG. 7. Upon selection of the interval (upon a match of the current count value of the interval counter and the interval index signal), the pixel is caused to transition from the on state to the off state.

In the case of a "half or less" waveform, the control circuit 308 operates to invert or "flip" the waveform. The greater the pixel value (not exceeding half of the refresh time), the sooner in the second half of the refresh time that the control circuit 308 applies the transition enable signal to select the super-interval in which the off-to-on transition is to occur. It may also be necessary to flip the interval index signal that is to be loaded in the interval index memory. The interval at which the off-to-on transition occurs is selected by the comparison circuit based on the enable signal, the interval index signal stored in the interval index memory and the current count value from the interval counter.

In some embodiments, it may be appropriate to insure that all pixels are in an off state at the end of the refresh time (e.g., to accommodate a transition by a color wheel). Waveforms of this type, incorporating a "dark time" at the end of each refresh time, are illustrated in FIG. 9. In the case of such waveforms, the term "cycle time" will be used to refer to the portion of the refresh time prior to the dark time. Where there is no dark time, "cycle time" will refer to the entire refresh time. In the example illustrated in FIG. 9, it should be understood that the cycle time, rather than the refresh time, may be divided into super-intervals and intervals.

The practice illustrated in FIG. 9 is essentially the same as that of FIG. 8 except that all pixels are constrained to be off during the dark time, and waveforms for which the on time is half or less than the duration of the cycle time are "flipped" so as to have an off-to-on transition in the second half of the cycle time.

In other embodiments, the PWM transitions could be excluded from a smaller portion than half of the cycle time. For example, the transitions could be excluded only from the first quarter or first third of the cycle time. Such embodiments may make it easier to deal with situations in which small adjustments of the pulse width are required. Such adjustments may be needed, for example, to compensate for non-uniform conditions across the pixel array.

The hardware arrangement described herein could be varied in a number of ways. For example, the circuitry shown in FIGS. 3 and 4 could be rearranged to employ a D flip-flop instead of a T flip-flop.

As another alternative, a capacitor from which a charge drains at a predetermined rate could be used in place of the interval counter.

The interval counter may be shared among some or all of the pixels. If only shared with some, an additional interval counter or counters may be provided to service the other pixels. As used in the appended claims, the phrase "an interval counter of the at least one interval counter" refers to (a) the interval counter if only one interval counter is provided, or (b) one of the interval counters if the at least one interval counter includes plural interval counters.

The embodiments described above have been concerned with liquid crystal on silicon (LCOS) display devices. However, the pixel driving arrangements described herein are also applicable to other types of display devices, such as so-called digital light processors (DLPs) in which a respective mirror corresponds to each pixel, and the mirrors are moved to actuate or deactuate the pixels.

The several embodiments described herein are solely for the purpose of illustration. The various features described herein need not all be used together, and any one or more of those features may be incorporated in a single embodiment.

Therefore, persons skilled in the art will recognize from this description that other embodiments may be practiced with various modifications and alterations.

What is claimed is:

1. A method comprising:

defining a plurality of super-intervals into which a cycle time is divided, each of the super-intervals being divided into a plurality of intervals;

storing an interval index for a pixel;

using an enable signal to select one of said super-intervals;

operating an interval counter;

comparing a current value of the interval counter with the stored interval index to select one of the intervals of the selected super-interval; and changing the pixel from one state to another state at a timing indicated by the selected interval;

wherein using the enable signal to select a super-interval allows a number of bits needed in a pixel memory to be reduced, and failure of the pixel memory has a reduced adverse effect on image quality.

2. The method of claim 1, wherein the intervals are all equal in duration, and the super-intervals are all divided into the same number of intervals.

3. The method of claim 1, wherein the pixel is changed from one state to another state by changing a flip-flop from one state to another state.

4. The method of claim 3, wherein the flip-flop is a T flip-flop.

5. An apparatus comprising:

a pixel;

a driver coupled to the pixel and configured to selectively drive the pixel;

a counter to provide an interval count;

a control circuit to selectively assert an enable signal; and a timing selection circuit coupled to the counter, to the control circuit, and to the driver, the timing selection circuit including an interval index memory which stores an interval index, the timing selection circuit responsive to said enable signal to select a super-interval from among a plurality of super-intervals into which a cycle time is divided, the timing selection circuit including a comparison circuit coupled to said counter and to said interval index memory to compare a current count value of the counter and the interval index stored in the interval index memory, said comparison circuit operative to select an interval from among a plurality of intervals into which said selected super-interval is divided, said comparison circuit operative to cause said pixel to be changed from one state to another state at said selected interval;

wherein using the enable signal to select a super-interval allows a reduced number of bits to be stored in the interval index memory, and failure of the interval index memory has a reduced adverse effect on image quality.

6. The apparatus of claim 5, wherein the timing selection circuit also includes a flip-flop that is coupled to the comparison circuit and to the driver and is configured to change its state in response to a comparison signal output from the comparison circuit.

7. The apparatus of claim 6, wherein the flip-flop is a T flip-flop.

8. An apparatus comprising:

a source of image data; and a display device coupled to the source of image data, the display device including:

a pixel array formed of a plurality of pixels;

at least one interval counter to provide an interval count;

a control circuit to provide a plurality of enable signals; and a plurality of driving circuits, each coupled to a respective one of the pixels, each of the driving circuits including:

a driver coupled to the respective one of the pixels and configured to selectively drive the respective one of the pixels; and a timing selection circuit coupled to a one of said at least one interval counter, to the control circuit, and to the driver, the timing selection circuit including an interval index memory which stores an interval index, the timing selection circuit responsive to a respective one of said enable signals to select a super-interval from among a plurality of super-intervals into which a cycle time is divided, the timing selection circuit including a comparison circuit coupled to said one of said at least one interval counter and to the interval index memory to compare a current count value of said one of said at least one interval counter and the interval index stored in the interval index memory, said comparison circuit operative to select an interval from among a plurality of intervals into which said selected super-interval is divided, said comparison circuit operative to cause the respective one of the pixels to be changed from one state to another state at said selected interval;

wherein the respective interval indices and enable signals for the timing selection circuits are generated on the basis of the image data; and wherein using the enable signal to select a super-interval allows a reduced number of bits to be stored in the interval index memory, and failure of the interval index memory has a reduced adverse effect on image quality.

9. The apparatus of claim 8 wherein each timing selection circuit also includes a flip-flop that is coupled to the comparison circuit of the timing selection circuit and to the driver of the driving circuit that includes the timing selection circuit, the flip-flop being configured to change its state in response to a comparison signal output from the comparison circuit.

10. The apparatus of claim 8, wherein each counter of the at least one counter is shared by a plurality of the driving circuits.

11. The apparatus of claim 8, wherein:

the pixels are driven by the driving circuits by pulse width modulation with pulses of varying width; and each pixel for which the respective pulse in a current cycle time has a width of less than a predetermined portion of the current cycle time is changed from an off state to an on state in the second half of the current cycle time.

12. The apparatus of claim 11, wherein the predetermined portion of the current cycle time is one-half of the current cycle time.

13. The apparatus of claim 12, wherein the enable signals for all of the timing selection circuits are always off in the first half of every cycle time.

14. The apparatus of claim 11, wherein the enable signals for all of the timing selection circuits are always off in an earliest super-interval of every cycle time.

15. The apparatus of claim 11, wherein the predetermined portion of the current cycle time is less than one-half of the current cycle time.

16. The apparatus of claim 8, wherein the enable signals for all of the timing selection circuits are always off in an earliest super-interval of every cycle time.

17. The apparatus of claim 16, wherein the enable signals for all of the timing selection circuits are always off in the first half of every cycle time.

18. An apparatus comprising:

a source of image data; and a display device coupled to the source of image data, the display device including:

a pixel array formed of a plurality of pixels;

at least one interval counter to provide an interval count;

a control circuit to provide a plurality of enable signals; and a plurality of driving circuits, each coupled to a respective one of the pixels, each of the driving circuits including:

a driver coupled to the respective one of the pixels and configured to selectively drive the respective one of the pixels; and a timing selection circuit coupled to a one of said at least one interval counter, to the control circuit, and to the driver, the timing selection circuit including an interval index memory which stores an interval index, the timing selection circuit responsive to a respective one of said enable signals to select a super-interval from among a plurality of super-intervals into which a cycle time is divided, the timing selection circuit including a comparison circuit coupled to said one of said at least one interval counter and to the interval index memory to compare a current count value of said one of said at least one interval counter and the interval index stored in the interval index memory, said comparison circuit operative to select an interval from among a plurality of intervals into which said selected super-interval is divided, said comparison circuit operative to cause the respective one of the pixels to be changed from one state to another state at said selected interval;

wherein the respective interval indices and enable signals for the timing selection circuits are generated on the basis of the image data;

wherein:

the pixels are driven by the driving circuits by pulse width modulation with pulses of varying width;

each pixel for which the respective pulse in a current cycle time has a width of less than a predetermined portion of the current cycle time is changed from an off state to an on state in the second half of the current cycle time;

the predetermined portion of the current cycle time is one-half of the current cycle time; and the enable signals for all of the timing selection circuits are always off in the first half of every cycle time.

19. An apparatus comprising:

a source of image data; and a display device coupled to the source of image data, the display device including:

a pixel array formed of a plurality of pixels;

at least one interval counter to provide an interval count;

a control circuit to provide a plurality of enable signals; and a plurality of driving circuits, each coupled to a respective one of the pixels, each of the driving circuits including:

a driver coupled to the respective one of the pixels and configured to selectively drive the respective one of the pixels; and a timing selection circuit coupled to a one of said at least one interval counter, to the control circuit, and to the driver, the timing selection circuit including an interval index memory which stores an interval index, the timing selection circuit responsive to a respective one of said enable signals to select a super-interval from among a plurality of super-intervals into which a cycle time is divided, the timing selection circuit including a comparison circuit coupled to said one of said at least one interval counter and to the interval index memory to compare a current count value of said one of said at least one interval counter and the interval index stored in the interval index memory, said comparison circuit operative to select an interval from among a plurality of intervals into which said selected super-interval is divided, said comparison circuit operative to cause the respective one of the pixels to be changed from one state to another state at said selected interval;

wherein the respective interval indices and enable signals for the timing selection circuits are generated on the basis of the image data;

wherein:

the pixels are driven by the driving circuits by pulse width modulation with pulses of varying width;

each pixel for which the respective pulse in a current cycle time has a width of less than a predetermined portion of the current cycle time is changed from an off state to an on state in the second half of the current cycle time; and the enable signals for all of the timing selection circuits are always off in an earliest super-interval of every cycle time.

20. An apparatus comprising:

a source of image data; and a display device coupled to the source of image data, the display device including:

a pixel array formed of a plurality of pixels;

at least one interval counter to provide an interval count;

a control circuit to provide a plurality of enable signals; and a plurality of driving circuits, each coupled to a respective one of the pixels, each of the driving circuits including:

a driver coupled to the respective one of the pixels and configured to selectively drive the respective one of the pixels; and a timing selection circuit coupled to a one of said at least one interval counter, to the control circuit, and to the driver, the timing selection circuit including an interval index memory which stores an interval index, the timing selection circuit responsive to a respective one of said enable signals to select a super-interval from among a plurality of super-intervals into which a cycle time is divided, the timing selection circuit including a comparison circuit coupled to said one of said at least one interval counter and to the interval index memory to compare a current count value of said one of said at least one interval counter and the interval index stored in the interval index memory, said comparison circuit operative to select an interval from among a plurality of intervals into which said selected super-interval is divided, said comparison circuit operative to cause the respective one of the pixels to be changed from one state to another state at said selected interval;

wherein the respective interval indices and enable signals for the timing selection circuits are generated on the basis of the image data; and wherein the enable signals for all of the timing selection circuits are always off in an earliest super-interval of every cycle time.

21. The apparatus of claim 20, wherein the enable signals for all of the timing selection circuits are always off in the first half of every cycle time.

22. The apparatus of claim 20 wherein each timing selection circuit also includes a flip-flop that is coupled to the comparison circuit of the timing selection circuit and to the driver of the driving circuit that includes the timing selection circuit, the flip-flop being configured to change its state in response to a comparison signal output from the comparison circuit.

23. The apparatus of claim 20, wherein each counter of the at least one counter is shared by a plurality of the driving circuits.

24. The apparatus of claim 20, wherein:

the pixels are driven by the driving circuits by pulse width modulation with pulses of varying width; and each pixel for which the respective pulse in a current cycle time has a width of less than a predetermined portion of the current cycle time is changed from an off state to an on state in the second half of the current cycle time.

25. The apparatus of claim 24, wherein the predetermined portion of the current cycle time is one-half of the current cycle time.

26. The apparatus of claim 24, wherein the predetermined portion of the current cycle time is less than one-half of the current cycle time.

* * * * *